US005355940A

United States Patent [19]

Snider

[11] Patent Number: 5,355,940

[45] Date of Patent: Oct. 18, 1994

[54] RADIANT HEAT APPARATUS

[76] Inventor: Gene P. Snider, P.O. Box 5093, Cheboygan, Mich. 49721

[21] Appl. No.: 130,708

[22] Filed: Oct. 4, 1993

[51] Int. Cl.[5] ..... F28D 9/02
[52] U.S. Cl. ..... 165/55; 165/57
[58] Field of Search ..... 165/55, 57

*Primary Examiner*—John C. Fox
*Attorney, Agent, or Firm*—E. Michael Combs

[57] ABSTRACT

A heat radiating conduit having heat radiating fins is arranged in adjacency to a pneumatic tube receiving pressurized air in cooperation with a thermostatic switch to actuate pressurizing of the tube upon obtaining predetermined ambient air temperature.

2 Claims, 4 Drawing Sheets

RADIANT HEAT APPARATUS

BACKGROUND OF THE INVENTION

1. Field of the Invention

The field of invention relates to radiant heat apparatus, and more particularly pertains to a new and improved radiant heat apparatus wherein the same is directed to the directing of pressurized air between heat radiating fins.

2. Description of the Prior Art

Radiant heat apparatus is available in the prior art and typically represented by a fluid conduit directing heated fluid therethrough, with the conduit further including various heat dispensing structure. The instant invention attempts to overcome deficiencies of the prior art by providing for, in addition to a heat conduit to employ radiant fins, a bore assembly to direct air between the fins to direct such heat throughout an environment.

SUMMARY OF THE INVENTION

In view of the foregoing disadvantages inherent in the known types of radiant heat apparatus now present in the prior art, the present invention provides a radiant heat apparatus including a pneumatic tube positioned in adjacency to radiant heating fins to direct pressurized air between the fins to project heated air throughout a dwelling. As such, the general purpose of the present invention, which will be described subsequently in greater detail, is to provide a new and improved radiant heat apparatus which has all the advantages of the prior art radiant heat apparatus and none of the disadvantages.

To attain this, the present invention provides a heat radiating conduit having heat radiating fins arranged in adjacency to a pneumatic tube receiving pressurized air in cooperation with a thermostatic switch to actuate pressurizing of the tube upon obtaining predetermined ambient air temperature.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention provide a new and improved radiant heat apparatus which has all the advantages of the prior art radiant heat apparatus and none of the disadvantages.

It is another object of the present invention to provide a new and improved radiant heat apparatus which may be easily and efficiently manufactured and marketed.

It is a further object of the present invention to provide a new and improved radiant heat apparatus which is of a durable and reliable construction.

An even further object of the present invention is to provide a new and improved radiant heat apparatus which is susceptible of a low cost of manufacture with regard to both materials and labor, and which accordingly is then susceptible of low prices of sale to the consuming public, thereby making such radiant heat apparatus economically available to the buying public.

Still yet another object of the present invention is to provide a new and improved radiant heat apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
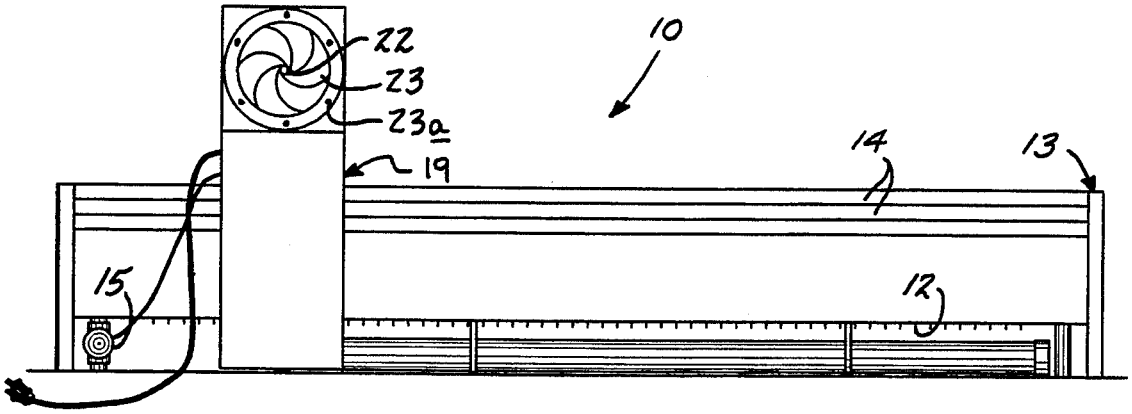
FIG. 1 is an orthographic frontal view of the invention.
Figure 2:
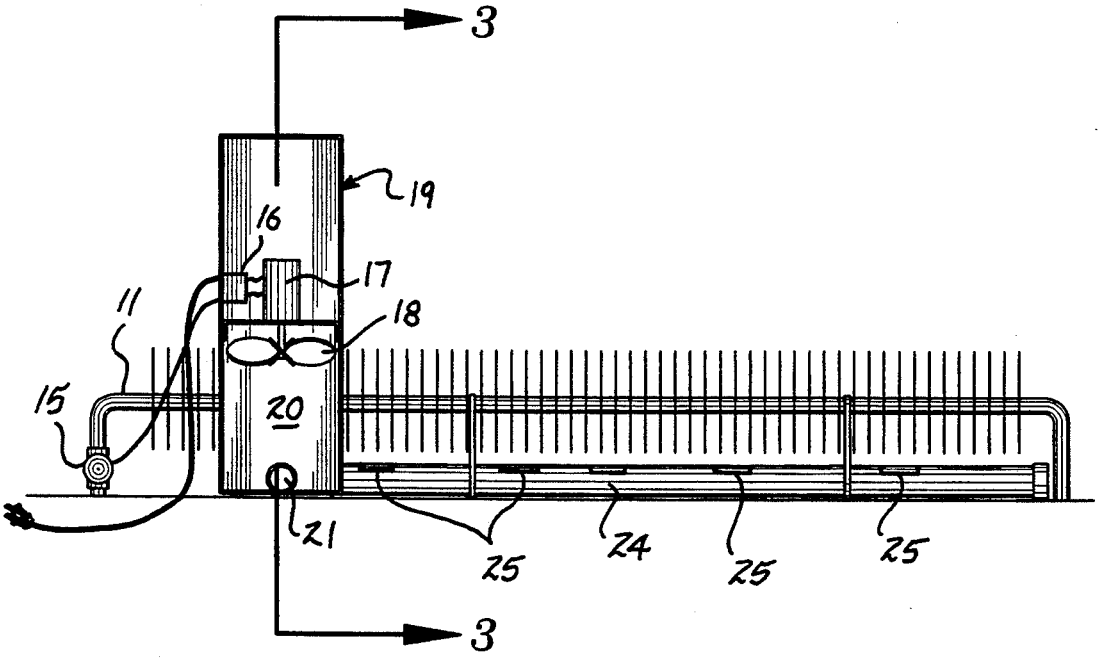
FIG. 2 is an orthographic view of the invention, partially in cross-section, indicating the heat radiating fins in cooperation with a fluid conduit.
Figure 3:
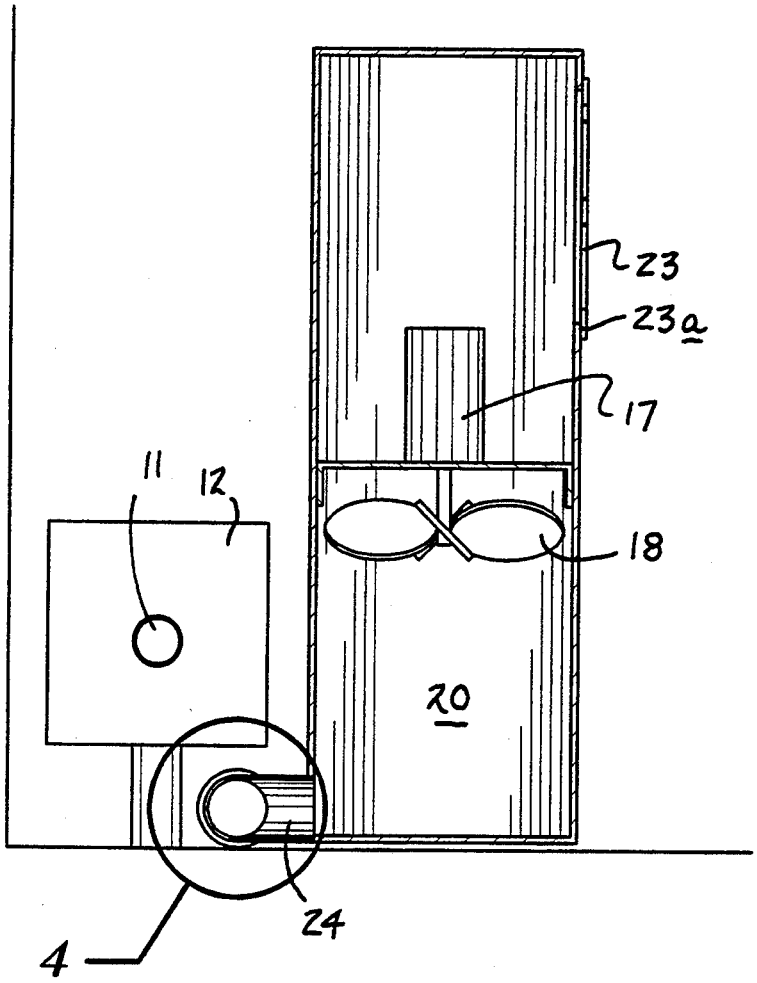
FIG. 3 is an orthographic partial view, taken along the lines 3—3 of FIG. 2 in the direction indicated by the arrows.
Figure 4:
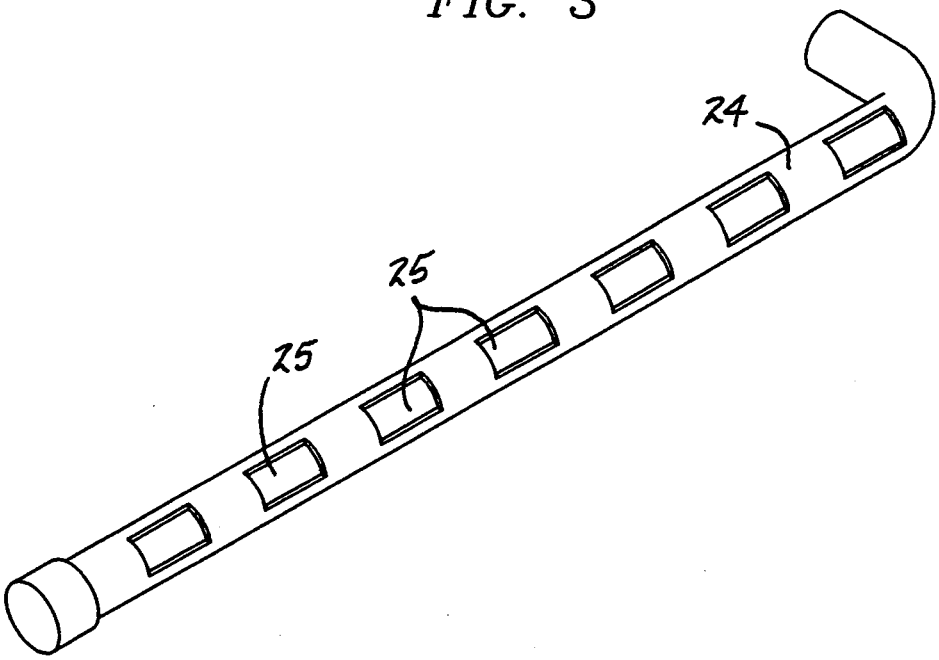
FIG. 4 is an enlarged isometric illustration of the fluid conduit structure, as indicated in section 4 of FIG. 3.

With reference now to the drawings, and in particular to FIGS. 1 to 7 thereof, a new and improved radiant heat apparatus embodying the principles and concepts of the present invention and generally designated by the reference numeral 10 will be described.

More specifically, the radiant heat apparatus 10 of the instant invention essentially comprises a fluid conduit 11 directing a heated fluid therewithin, wherein a plurality of spaced heat radiating fins 12 are fixedly and orthogonally mounted to the fluid conduit 11 projecting radially therebeyond. Typically, the fluid conduit 11 and the heat radiating fins 12 are positioned within a primary housing 13, such as indicated in FIG. 1, wherein the primary housing 13 includes ventilation slots 14 to permit radiant heat directed therethrough. A thermostatic switch 15 is provided to effect actuation of a blower motor 17 through a blower fan switch 16 that is positioned within a fan housing 19. A pneumatic chamber 20 is positioned below the fan blades 18 of the blower motor 17, such that pneumatic chamber 20 is pressurized and permitting such pressurized air to be directed through an outlet 21. Above the fan blades 18 within the fan housing 19 is a fan housing inlet opening 22 to direct air therein to the housing, such that pivoted arcuate blade plates 23 concentric about the inlet opening 22 are each pivotally mounted about a plate axle **2*a* permit selective opening and closing relative to the inlet opening 22 to control air directed into the fan housing 19. In this manner, pressurized air is directed through a pneumatic tube 24 that is positioned substantially coextensively with the heat radiating fins 12, such that the tube 24 is oriented substantially parallel to the fluid conduit 11, with the tube 24 including outlet ports 25 (see FIG. 14) arranged in a facing relationship relative to the fins 12** to direct pressurized air through the fins for directing such heated air into a room environment.

Figure 5:
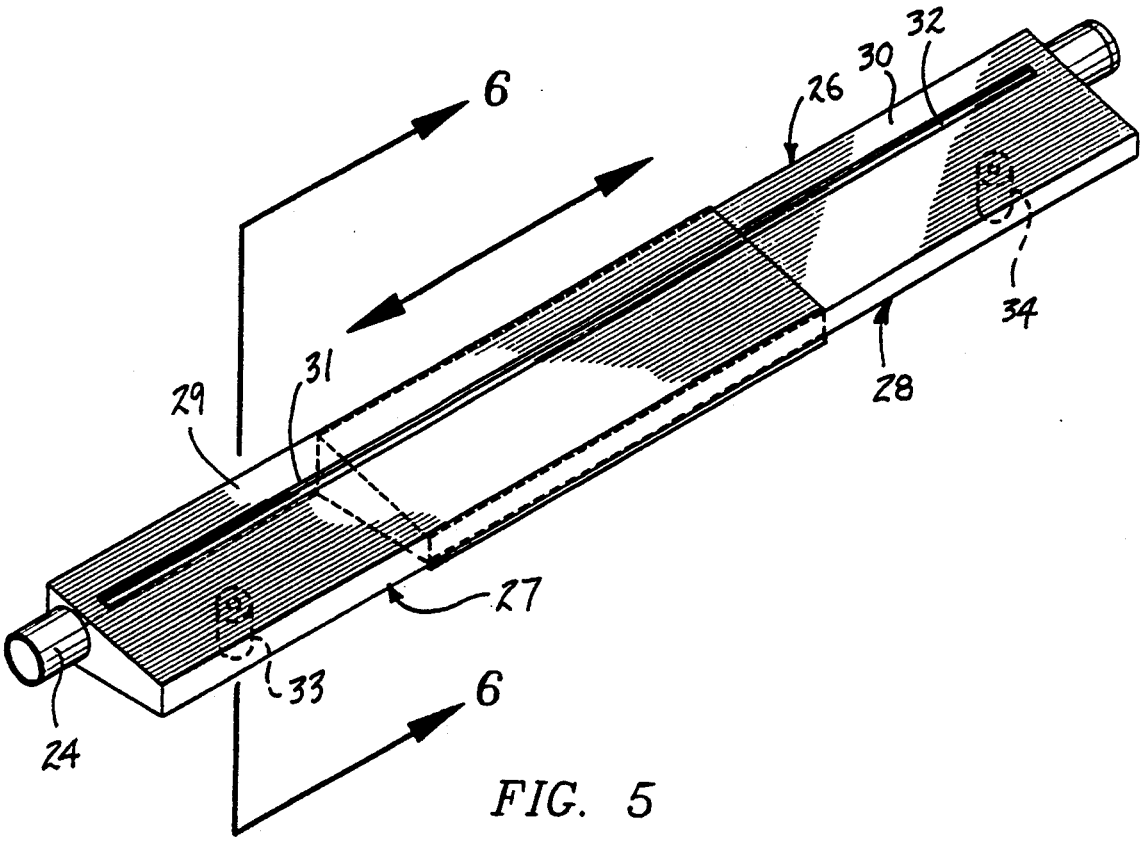
FIG. 5 is an isometric illustration of a pneumatic housing in cooperation with the use of a pneumatic conduit.
Figure 6:
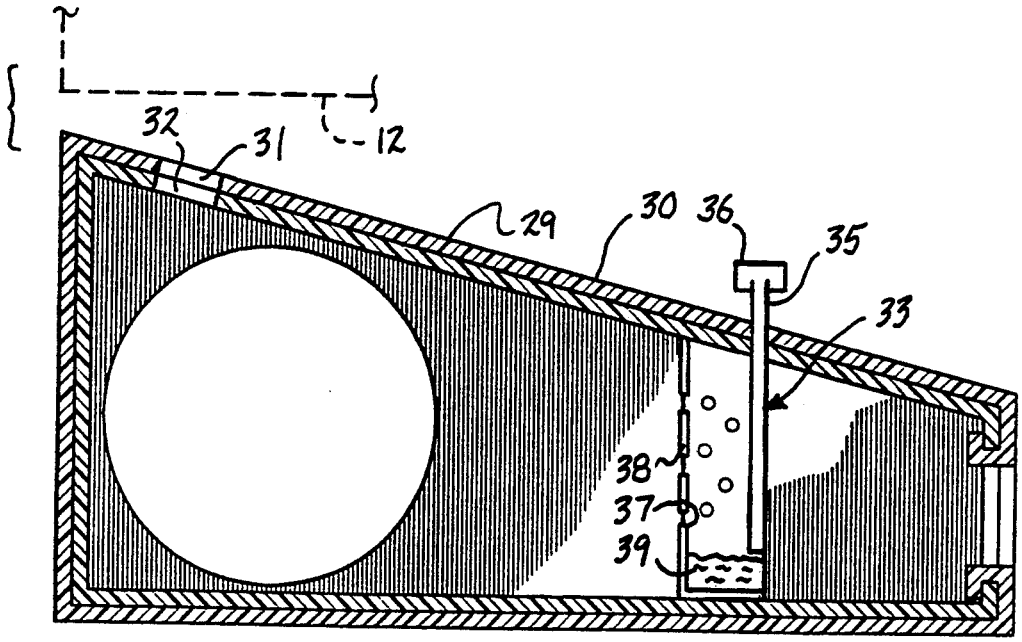
FIG. 6 is an orthographic view, taken along the lines 6—6 of FIG. 5 in the direction indicated by the arrows.

The FIGS. 5 and 6 indicate the use of a pneumatic housing 26 receiving pressurized air from the pneumatic tube 24. The pneumatic housing 26 includes a first housing 27 telescopingly receiving a second housing 28, with the first and second housings 27 and 28 having parallel first and second housing top wails 29 and 30, having respective first and second slots 31 and 32 aligned and overlapping one another to provide for a through-extending slot structure to direct pneumatic pressurized air therethrough, such that the first and second slots 31 and 32 are arranged in a facing relationship relative to the heat radiating fins 12. The first and second slots 31 and 32 are further canted relative to the fins to effect further directing of air into a dwelling environment beyond the fins 12.

Further, the respective first and second housings 27 and 28 include respective first and second fluid housings 33 and 34 contained therewithin. Each of the fluid housings includes a fluid supply tube 35 directed through a respective top wall, with the fluid supply tube 35 having a removable cap 36. The fluid supply tube 35 is directed through a fluid housing, such as a fluid housing 33, and positioned in adjacency to a housing reservoir 37 at a lowermost end of the fluid housing. The housing reservoir 37 contains a volatile aromatic fluid 39 therewithin, wherein pressurized air within the housing, such as the first housing 27, directs such pressurized air through the apertured side wall 38 of the fluid housing structure to permit such airborne vapors to be directed through the first and second slot structures 31 and 32 of the respective first and second housings 27 and 28. In this manner, such structure additionally provides for the use of directing aromatic vapors throughout a room environment to enhance comfort within a dwelling.

Figure 7:
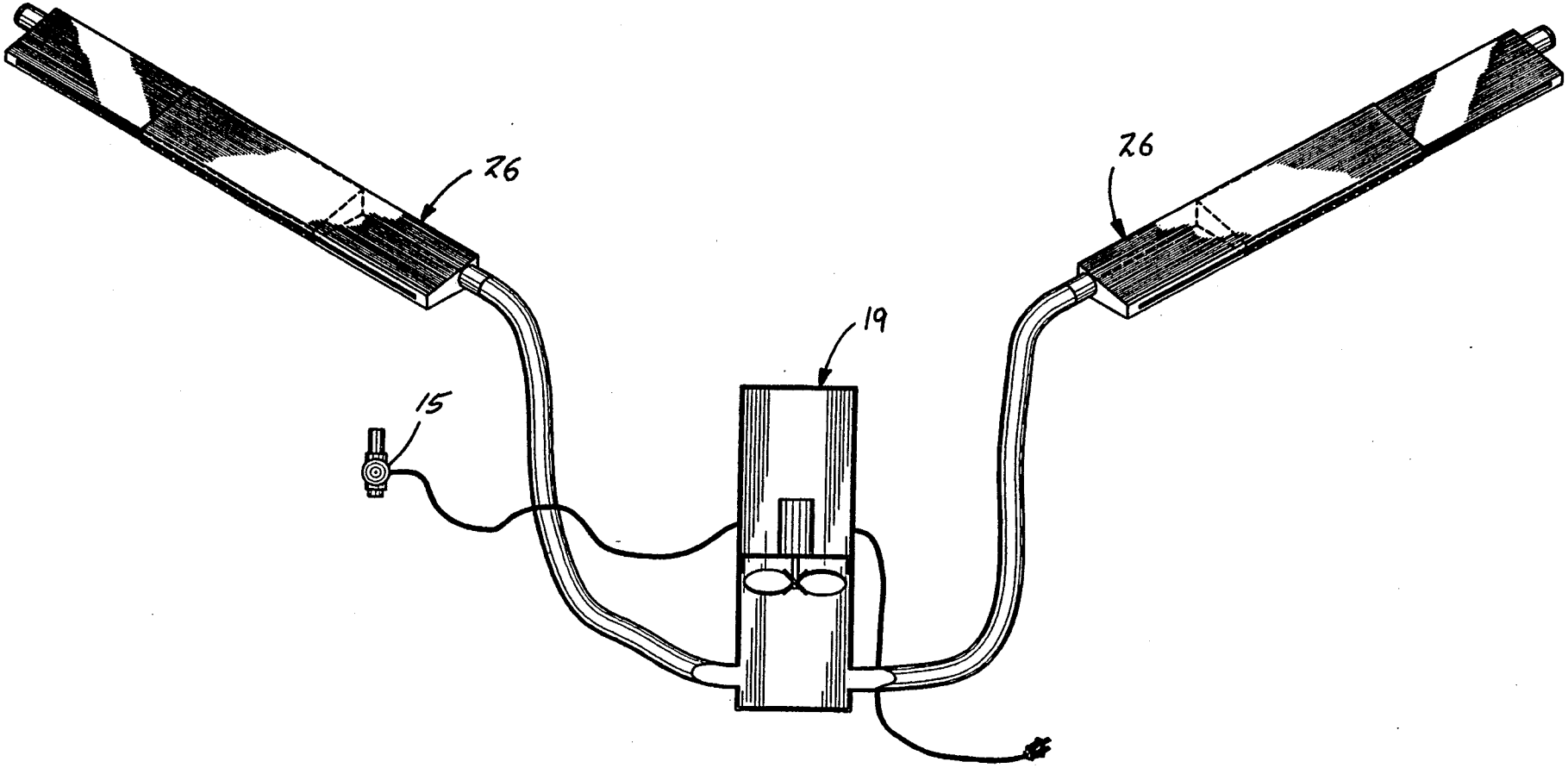
FIG. 7 is an isometric illustration, partially in section, of the pneumatic lower housing in cooperation with a plurality of pneumatic housings for application to a plurality of heat conducting fluid conduits and associated fin structure.

The FIG. 7 indicates that a plurality of such housing 26 may be employed, such that the fan housing 19 includes a plurality of outlets directing pressurized air to the individual housings 26.

It should be noted that the deodorizing fluid 39, as indicated in FIG. 6, may be of any commercially available type that permits the fluid to volatilize particularly in the presence of heated air which is typical of such fluids.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

What is claimed as being new and desired to be protected by Letters Patent of the United States is as follows:

1. A radiant heat apparatus, comprising, a fluid conduit, the fluid conduit arranged to receive a heated fluid therethrough, and the fluid conduit including a plurality of spaced heat radiating fins fixedly mounted to the fluid conduit extending beyond the fluid conduit, and a fan housing positioned adjacent the fluid conduit, with the fan housing including an upper chamber and a lower chamber, and a blower motor oriented between the upper chamber and the lower chamber, with the blower motor having fan blades directed in facing relationship relative to the lower chamber effecting pneumatic pressurizing of the lower chamber, and an air inlet opening directed into the upper chamber, with the upper chamber in pneumatic communication with the ,lower chamber, and the lower chamber having a lower chamber outlet, with a pneumatic housing positioned in pneumatic communication with the chamber outlet, with the pneumatic housing directed coextensively with the heat radiating fins, and the pneumatic housing having at least one outlet port directing pressurized air from the lower chamber through the pneumatic housing, and the pneumatic housing includes a first housing member and a second housing member, with the second housing member telescopingly received within the first housing member, with the first housing member having a first top wall, the second housing member having a second top wall, with the first top wall and the second top wall arranged in a sliding parallel relationship relative to one another coextensive with the heat radiating fins, and a first slot directed through the first top wall, and a second slot directed through the second top wall, wherein the first slot and the second slot are arranged in an overlapping relationship to define an exit slot in facing relationship relative to the heat radiating fins.

2. An apparatus as set forth in claim 1 wherein at least said first housing includes a fluid housing, and the fluid housing having a fluid supply tube extending through the fluid housing and through the top wall projecting beyond the top wall, with a cap removably mounted relative to the fluid supply tube exteriorly of the first top wall and the first housing, and a housing reservoir mounted within the fluid housing in facing relationship relative to the fluid supply tube, with the hounding reservoir containing a volatile aromatic deodorizing fluid contained therewithin, and the fluid housing having an apertured side wall to direct vapors from said deodorizing fluid into the first housing and through the first slot.

* * * * *